US006533439B1

(12) United States Patent
Duflos et al.

(10) Patent No.: US 6,533,439 B1
(45) **Date of Patent: *Mar. 18, 2003**

(54) INDICATING LIGHT UNIT WITH ADDITIVE SYNTHESIS FOR A MOTOR VEHICLE

(75) Inventors: Vincent Duflos, Sens (FR); Régis Duplessy, Paron (FR); Benoist Fleury, Vincennes (FR); Vincent Godbillon, Paris (FR)

(73) Assignee: Valeo Vision, Bobigny Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/078,089

(22) Filed: May 13, 1998

(30) Foreign Application Priority Data

May 15, 1997 (FR) ..... 97 05980

(51) Int. Cl.[7] ..... F21V 21/14; F21V 35/00

(52) U.S. Cl. ..... 362/293; 362/257; 362/507; 362/510; 362/521

(58) Field of Search ..... 362/257, 293, 362/507, 510, 521, 230, 231

(56) References Cited

U.S. PATENT DOCUMENTS 3,648,229 A * 3/1972 Burrows et al. ..... 340/956
4,241,388 A * 12/1980 Green ..... 362/293
4,835,666 A * 5/1989 Feger et al. ..... 362/293
5,555,492 A 9/1996 Feger ..... 362/293

FOREIGN PATENT DOCUMENTS

| | | | |
|---|---|---|---|
| DE | 42 28 928 | 12/1993 | |
| DE | 44 25 401 | 2/1996 | |
| EP | 0 211 742 | 2/1987 | |
| EP | 0274325 | * 12/1987 | ..... 362/510 |
| FR | 2 530 781 | 1/1984 | |
| JP | 2-123604 | * 5/1990 | ..... 362/510 |

OTHER PUBLICATIONS

French Search Report dated Jan. 2, 1998.

* cited by examiner

*Primary Examiner*—Cassandra Spyrou
*Assistant Examiner*—Leo Boutsikaris
(74) *Attorney, Agent, or Firm*—Morgan & Finnegan, LLP

(57) ABSTRACT

An indicator light for a motor vehicle includes a divider screen adapted to divide a light beam into a plurality of elementary light beams which are then added together downstream of the dividing screen. A first coloring means, for coloring some of the elementary light beams, is located at a distance from the divider screen. The light unit includes a second coloring means adapted to color at least some of the elementary light beams, the second coloring means being spaced away from the divider screen and the first coloring means.

11 Claims, 1 Drawing Sheet

INDICATING LIGHT UNIT WITH ADDITIVE SYNTHESIS FOR A MOTOR VEHICLE

FIELD OF THE INVENTION

This invention relates to indicating light units, especially for motor vehicles.

BACKGROUND OF THE INVENTION

It is known from European patent specification No. EP 0 211 742 B1 to provide an indicating light unit for a motor vehicle, comprising a light source and a dividing screen which is adapted to divide the light beam emitted from the light source into two sets of elementary beams, in such a way that these two sets of beams are then added together downstream of the dividing screen. This screen comprises two sets of color filters of two different colors, which are adapted to color the respective sets of elementary beams in these two colors. The addition of the two sets of elementary beams, thus colored separately, produces by additive synthesis an emergent beam in a color which is appropriate to the particular function that the indicator light is to serve. This color is different from that of the divider screen when the light is extinguished, which can be of advantage as regards the appearance of the vehicle. However, such a light unit has the disadvantage that manufacture of the screen with the dividing and coloring surfaces is difficult and expensive.

In addition, the ways in which the dividing and coloring surfaces can be arranged are limited, which in turn severely limits the scope for adapting the appearance of the extinguished light to the styling of the vehicle.

SUMMARY OF THE INVENTION

An object of the invention is to provide an indicating light unit which will be easier to make, and less expensive, and which further offers the possibility of adapting the appearance of the extinguished light to that of the vehicle.

According to the invention, a indicating light unit, especially for a motor vehicle, which includes a divider screen adapted to divide a light beam into a plurality of elementary beams which are added together again downstream of the divider screen, and a first coloring means adapted to color some of the elementary beams and lying at a distance from the divider screen, is characterised in that it includes a second coloring means adapted to color at least some of the elementary beams and lying at a distance from the divider screen and the first coloring means.

Thus it is possible to manufacture separately, firstly the second coloring means, and secondly the dividing screen and the first coloring means. They are thus easier and less expensive to make. In addition, the scope for providing different arrangements of the dividing and coloring surfaces on these elements in different ways is increased. This then offers further advantages with regard to adapting the appearance of the extinguished light to the styling of the vehicle. One of the coloring means could for example be situated upstream with respect to the other optical elements of the light unit, so that it can hardly be seen from the outside when the light is extinguished.

The second coloring means are preferably upstream of the first coloring means.

Preferably, the second coloring means is upstream of the divider screen.

Preferably, the second coloring means comprises a uniform monochrome colored screen.

Thus, the second coloring means is particularly simple and inexpensive to make.

In addition, some of the elementary light beams are colored at the same time by the first coloring means and the second coloring means in a subtractive synthesis process. The emergent beam is therefore totally produced in accordance with a subtractive-additive synthesis technique. Such a technique enables a suitable color to be obtained in the emergent beam of the light unit. In addition, the second coloring means increases the scope for choice as to how the coloring surfaces are arranged, and for choice of the colors used for the various coloring means so as to give an appropriate appearance to the extinguished light. Thus the scope for adaptation of the appearance of the extinguished light to the styling of the vehicle is increased even more.

Preferably, the second coloring means is adapted to collimate the beam emitted by the light source. Thus, the second coloring means has a double function. It may for example consist of a bonnet.

The first coloring means preferably comprises filters of a first color and filters of a second color, adapted to color the respective elementary beams.

Preferably, the first coloring means is adapted to leave unchanged the color of some of the elementary beams passing through it. In this way the number of colors to be used in the manufacture of the first coloring means is reduced. If this manufacture includes a moulding step, the cost of the tooling is reduced.

Preferably, the first coloring means comprises uncolored filters and a junction portion which is integral with the uncolored filters. With this feature, the presence of the junction portion facilitates manufacture of the first coloring means by moulding. In particular, the uncolored filters can be made in a single injection, through a single feed common to all of the filters. The structure of the mould is thus simplified.

The junction portion preferably comprises a layer which lies in a general plane at right angles to a general direction of propagation of the elementary beams. Manufacture of the junction portion is therefore particularly simple.

The said layer preferably extends along a face of the first coloring means.

The light unit may include first and second light sources associated with a divider screen, the first coloring means being associated with both light sources, and the second coloring means being associated only with the first light source. Accordingly, although the light unit is able to provide two different indicating functions associated with the two light sources, the first coloring means gives a uniform appearance to the extinguished light unit.

In some embodiments, the light unit further includes a third coloring means adapted to color the elementary beams from the second light source, and lying at a distance from the divider screen and from the first coloring means, being associated with only the second light source.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
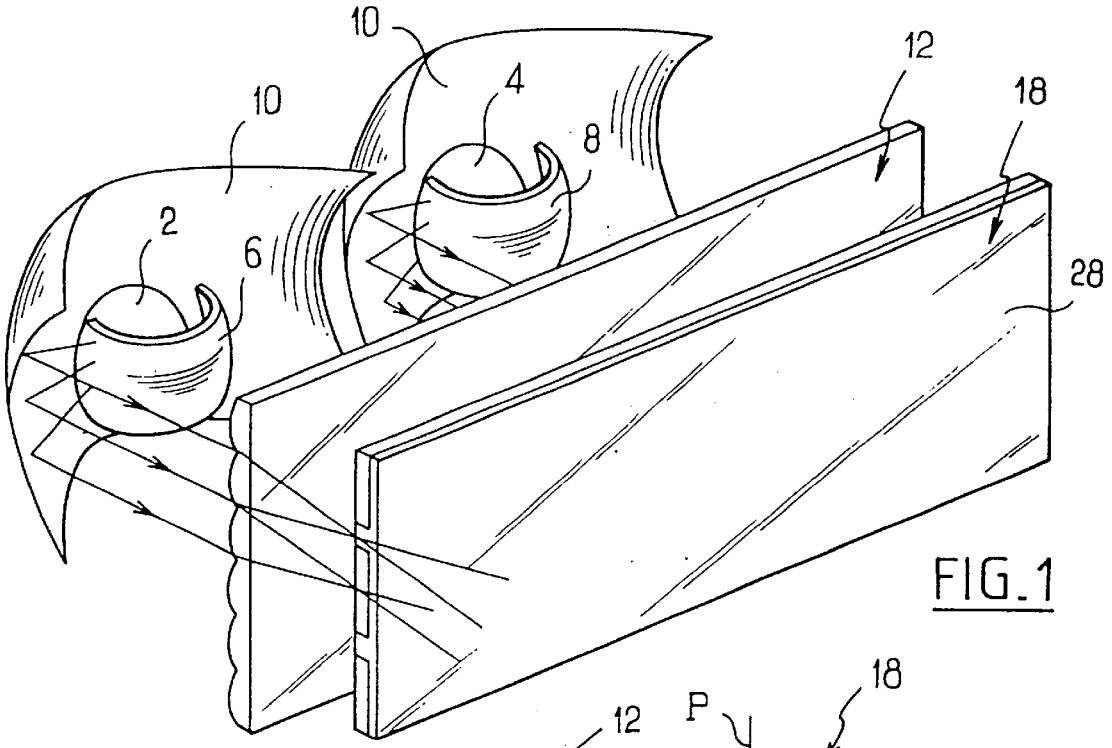
FIG. 1 is a perspective view of an indicating light unit in a preferred embodiment of the invention.

The indicator light unit in FIG. 1 is an indicator light unit for a motor vehicle, which provides in this example two signalling functions, namely the direction indicating function and the reversing light function.

Figure 2:
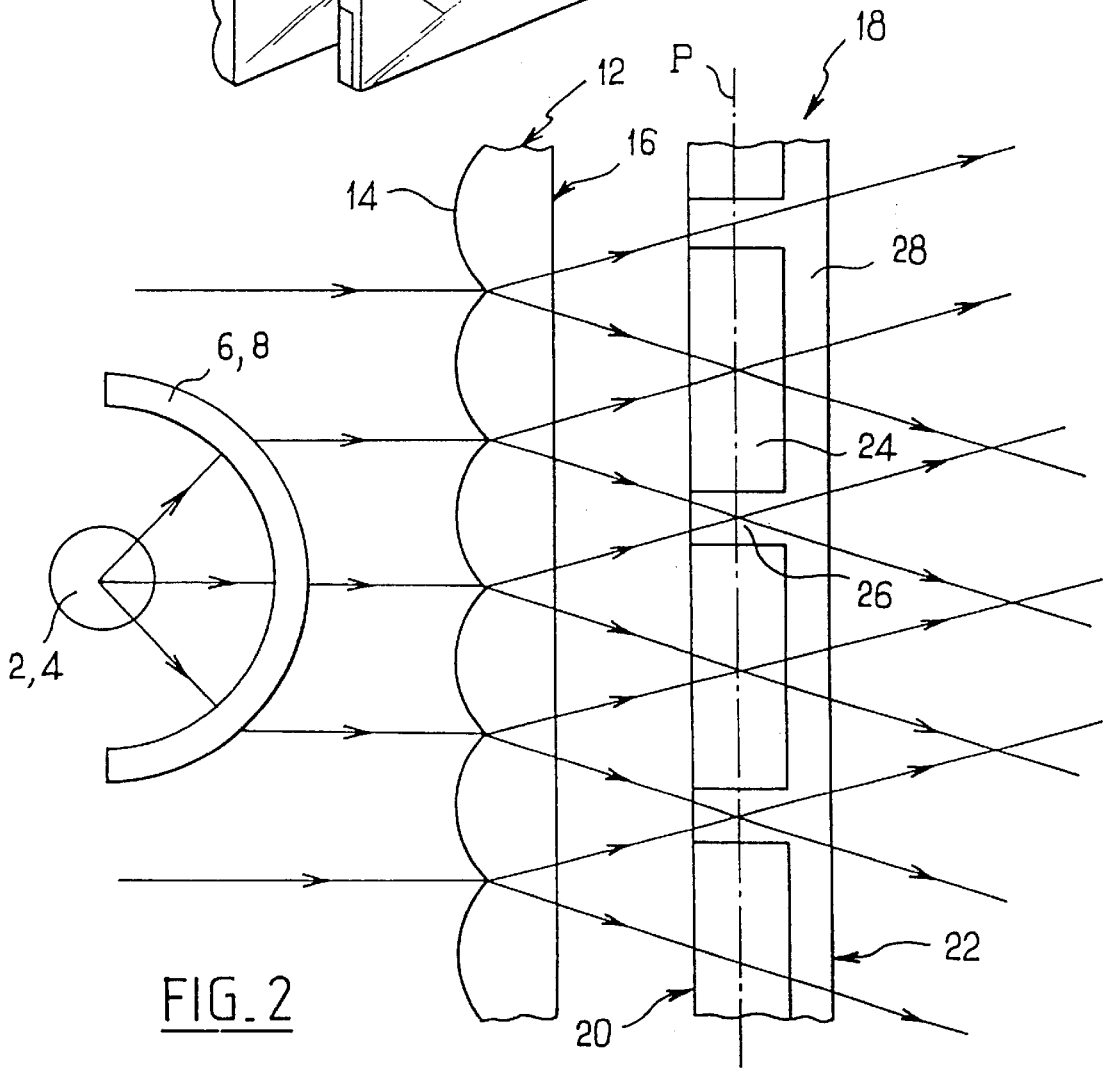
FIG. 2 is a view in vertical cross section of the light unit shown in FIG. 1, along an axis of one of its light sources.

The light unit comprises a body, not shown, which carries the various optical elements of the unit. It includes two bulbs 2 and 4 disposed side by side and constituting substantially uncolored light sources. Each light bulb 2, 4 emits a substantially spherical beam. The light unit also includes two bonnets 6 and 8, known per se and having a generally spherical form, surrounding the respective bulbs 2 and 4, with which they are concentric. Each bonnet converts the spherical light beam, with radial rays, emitted by the associated bulb into a beam in which the light rays, constituting elementary beams, are propagated in planes parallel to each other. As shown in FIG. 2, each bonnet 6, 8 converts the associated spherical beam into a straight beam comprising horizontal elementary beams in the form of horizontal rays or light layers.

Each bonnet 6, 8 is of uniform monochrome color (i.e. it is in one color), so as to color uniformly the whole of the beam emitted by the bulb 2 or 4. The first bulb 2 is associated with the direction indicating function. The color of the bonnet 6 corresponds in this example to the trichromatic coordinates x=0.515 and y=0.478. The second bulb 4 is associated with the reversing light function. The associated bonnet 8 is colored with a color which has trichromatic coordinates x=0.400 and y=0.432.

The indicating light unit also includes two preliminary reflectors 10 which are disposed behind the respective bonnets 6 and 8 with reference to the direction of the beam emerging from the unit. Each reflector 10 is so configured that the cross sections of the reflector, parallel to the planes of the light rays emitted by the bonnets 6, 8, in this example the horizontal cross sections of the reflector, are parabolas. As a result, the light rays transmitted by each bonnet 6, 8 towards the rear or towards the sides, and reflected by the associated reflector 10, are directed forward in their elementary beams parallel to the axis of the light unit, while remaining horizontal.

The light unit includes a divider screen 12, or concentrating screen, of generally flat form and disposed in a plane which is at right angles to the axis of the light unit, at right angles to the general direction of the beam emerging from the bonnets 6 and 8, part of which has been reflected by the reflectors, so that the two beams pass entirely through the divider screen 12.

The divider screen 12 is spaced away from the bonnets 6 and 8, downstream of the latter with reference to the direction of propagation of the beams. The divider 12 has on its upstream face godroons 14 which consist of profiled surfaces with arcuate profiles defining cylindrical sectors. All of the godroons have the same form and the same dimensions. They are disposed side by side with their axes parallel to each other and horizontal. The centres of curvature of the cylindrical surfaces are situated downstream of the godroons, the latter being convex. Each godroon 14 serves as a convergent lens. When the main beam emitted from the bonnet and/or reflector is incident at the upstream face of the divider 12, it consists of the said elementary beams with horizontal rays, parallel to each other, which are incident on the respective godroons 14. Each godroon 14 converts the incident elementary beam into a beam which is convergent in a vertical plane with respect to the horizontal direction, as shown in FIG. 2. The divider 12 has a flat downstream face 16. In this example the divider screen is uncolored.

The indicator light unit further includes a coloring screen 18, also referred to in this Application as the first coloring means. The screen 18 is of generally flat form, and is disposed parallel to the divider screen 12, being spaced away from the latter and downstream of it. The coloring screen 18 has an upstream face 20 and a downstream face 22, both of which are flat, and which are parallel to each other. The coloring screen 1 8 includes two sets of filters, namely a set of filters 24 which in this example are red, the red having the trichromatic coordinates x=0.676 and y=0.323, and a set of uncolored or "crystal" filters 26.

The red filters 24 and the uncolored filters 26 are in the form of rectangular parallelepipeds which are aligned in the horizontal direction. They extend parallel to each other, one above the other and contiguous with the upstream face 20 of the coloring screen. The red filters 24 are of self-colored plastics material. The red filters 24 and the uncolored filters 26 are arranged alternately in the vertical direction. Each filter 24 or 26 lies in alignment with a respective godroon 14 of the divider screen 26, and the axis of each godroon 14 and the axis of the associated filter 24 or 26 are parallel to each other, with all of these axes lying in a common horizontal plane.

The red filters 24 have a height which is very much greater than that of the uncolored filters 26, so that the red filters 24 may be called "wide filters" and the uncolored filters 26 may be called "narrow filters". The divider screen 12 and the coloring screen 18 are disposed in such a way that the vertical focal plane P, in which the focal axes of the godroons 14 lie, extends through the centre of the red filters 24 and the uncolored filters 26, being halfway between the upstream face 20 and the downstream face of the filters.

The coloring screen 18 also includes a flat layer 28 which lies in front (downstream) of the filters 24 and 26, and which defines the downstream or front face 22 of the screen. This layer 28 is uncolored, and extends continuously and integrally with the narrow or uncolored filters 26, so as to constitute a junction portion joining the latter together. The coloring screen 18 also includes a red frame, not shown, which lies in the plane of the filters 24 and 26 and surrounds the latter so as to constitute a continuous junction portion integral with the red filters 24. The coloring screen 18 is made by superimposed moulding of two transparent plastics materials, one of which is red and the other uncolored. Each of these is put in place in a respective single injection into the mould, through a respective single feed inlet.

The coloring screen 18 is arranged to receive the whole of the beam emitted by each light source 2 or 4, after the beam has passed through the divider screen 12. The coloring screen 18 in this example constitutes the exit lens of the indicator light unit, the downstream face 22 being an external face in contact with the environment.

For the direction indicating function associated with the light source 2, the light unit operates in the following way.

The uncolored main beam emitted by the light source 2 passes through the bonnet 6 and is thereby colored yellow. The elementary beams constituting this main beam are incident on the front face of the divider screen 12, being oriented in the horizontal direction. By passing through the respective godroons 14, the elementary beams are converted into beams which are convergent in a vertical plane as shown in FIG. 2. Some of the elementary beams converge towards the centre of the red filters 24 and pass through these filters. The other elementary beams converge towards the centre of the uncolored filters 26, through which they pass. All of the elementary beams then pass through the uncolored transparent layer 28. Thus, there emerges from the front face 22 of the coloring screen 18 a first set of elementary beams which are colored in a color resulting from the subtractive synthesis of the color of the bonnet 6 followed by the red color of the filters 24. There also emerges from the front face 22 a second set of elementary beams which are colored in a yellow color by the bonnet 6 and not modified by the uncolored filters 26. The elementary beams of these two assemblies are alternate in the vertical direction. Downstream of the coloring screen 18, and in this example at a distance from the latter, the two sets of elementary beams mix in an additive synthesis process so as to produce the beam which emerges from the indicator light unit itself. This exit beam is of a uniform monochrome amber color, appropriate to an indication of a change of direction.

Alternatively, the indicator light unit can serve as a reversing light when the second light source 4 is energised instead of the first light source 2. This time, the uncolored rays from the light source are colored green by the bonnet 8. As before, the divider screen 12 divides the main beam into two sets of convergent elementary beams. The elementary beams in one of these sets then pass through the red filters 24 of the coloring screen 18 and are thus colored by subtractive synthesis in a color the trichromatic coordinates of which are x=0.667 and y=0.331; while the elementary beams in the other set undergo no change of color when passing through the uncolored filters 26. The additive synthesis of the two sets of elementary beams this time produces a monochrome white uniform emergent beam appropriate to the reversing light function.

Thus, the first coloring screen 18 takes part in the synthesis of the emergent beam of the light unit regardless of which light source is energised. In other words regardless of the function which is controlled, whether the latter be direction indication or reversing. The coloring screen gives the light unit a generally red monochrome appearance when the lights are extinguished, due to the presence of the red filters 24 and the uncolored filters 26. This effect is the more pronounced as the height of the red filters 24 is greater than that of the uncolored filters 26. The reduction in the height of the uncolored filters 26 is permitted by the arrangement of the focal plane P of the dividing screen 12 in the centre of the filters 26.

In a preferred arrangement, the uncolored filters 26 can be given a trapezoidal form in transverse vertical cross section, with the narrower of the two parallel sides of the trapezium being downstream and lying in the focal plane P of the godroons. In this way the height of the downstream face of the uncolored filters 26 visible from the outside when the indicator light is extinguished is reduced.

Other color combinations are possible, as is illustrated by the following example. In this example, the bonnet 6 of the direction indicator is given a color which has the trichromatic coordinates x=0.567 and y=0.432, while the reversing light bonnet 8 is left uncolored. The wide filters 24 of the coloring screen 18 are then given the color having the coordinates x=0.670 and y=00.329, while the narrow filters 26 have the color the coordinates of which are x=0.375 and y=0.445.

In this example, the layer 28, which this time is colored, can remain so that the two sets of elementary beams have their color modified by subtractive synthesis through the layer 28, without however this being detrimental to obtaining a color suitable for each of the two functions. To that end, it is in particular possible to make the layer 28 very thin. This layer may be on the upstream face 20 of the coloring screen.

Numerous other modifications to the invention may be considered without departing from the spirit of the invention. For example the disposition of the various elements in the upstream and downstream directions can be varied.

The optical surfaces of the divider screen may be in the form of generally spherical lenses disposed in a matrix, the filters being rectangular or square and being also arranged in a matrix. For the set of elementary beams associated with the wide filters, the godroons could be concave so as to cause the elementary beams to diverge. The two light sources could be associated with different divider screens.

What is claimed is:

1. An indicating light unit for a motor vehicle, comprising:

a light source adapted to produce a light beam;

a first screen downstream of the light source in the direction of propagation of the light beam, the first screen adapted to divide the light beam into a plurality of convergent beams, said first screen comprising an upstream face having a plurality of godroons;

a second screen spaced apart from the first screen, comprising a first light transmitting filter and a second light transmitting filter, each of said filters having a center and at least one of the filters being colored, wherein the second screen is downstream from the first screen in the direction of propagation; and a third filter of a uniform monochrome color, wherein the third filter is distinct from the first screen and the second screen such that the third filter is upstream of the first screen.

2. A light unit according to claim 1, wherein the third filter is adapted to collimate the light beam emitted by the light source.

3. A light unit according to claim 1, wherein the first filter is a different color than the second filter.

4. A light unit according to claim 1, wherein the second screen comprises uncolored filters and a junction portion joining said uncolored filters integrally together.

5. A light unit according to claim 4, wherein the junction portion comprises a layer lying in a general plane at right angles to the general direction of propagation.

6. A light unit according to claim 5, wherein said layer defines a face of the second screen.

7. A light unit according to claim 1, wherein the light source comprises a first light bulb and a second light bulb, the first screen and second screen being disposed so as to receive light emitted from the first light bulb and light emitted from the second light bulb, the third filter being arranged to receive and color light from only the first light bulb.

8. A light unit according to claim 7, further including a fourth filter adapted to receive and color light from only the second light bulb.

9. The light unit of claim 1, wherein the godroons of the first screen comprise a plurality of profiled surfaces with arcuate profiles defining cylindrical sectors, the godroons being disposed side by side with their axes parallel to each other.

10. The light unit of claim 1, wherein the second screen comprises a set of red filters and a set of uncolored filters arranged alternatively in a vertical direction, each of the filters being aligned with a respective godroon of the first screen.

11. A light unit, comprising:

a first light source and a second light source, said light sources being adapted to emit substantially uncolored light beams;

a plurality of bonnets adapted to convert the uncolored light beams emitted by the light sources into colored beams propagating in planes substantially parallel to each other, each of said bonnets being a uniform monochrome color;

a separate first screen downstream of the bonnets in the direction in which the light beams propagate, the first screen adapted to divide the light beams emerging from the bonnets into a plurality of convergent beams, the first screen comprising an upstream face having a plurality of godroons;

a separate second screen downstream of the first screen, the second screen comprising a first set of light transmitting filters having a first color, a second set of light transmitting filters having uncolored filters or a second color, and a junction portion downstream of the first set of filters, the first screen focusing one portion of the convergent beams toward a center of at least one of the filters in the first set and another portion of the convergent beams toward a center of at least one of the filters in the second set.

* * * * *